United States Patent [19]

Sherman

[11] Patent Number: 4,937,884

[45] Date of Patent: Jul. 3, 1990

[54] EXPANDABLE SHIRT COLLAR

[76] Inventor: Gary L. Sherman, 2401 Pine Lake Dr., West Columbia, S.C. 29169

[21] Appl. No.: 414,719

[22] Filed: Sep. 29, 1989

[51] Int. Cl.[5] ..... A41D 27/18

[52] U.S. Cl. ..... 2/129; 2/60; 2/141 R

[58] Field of Search ..... 2/129, 130, 131, 132, 2/144, 145, 60, 137, 138, 141 R, 237, 127, 115, 116

[56] References Cited

U.S. PATENT DOCUMENTS

| | | | |
|---|---|---|---|
| 790,064 | 5/1905 | Lawrence | 2/129 |
| 793,387 | 6/1905 | Mugford et al. | 2/138 |
| 932,848 | 8/1909 | Dorf | 2/138 |
| 1,048,633 | 12/1912 | Zurn | 2/237 |
| 1,056,443 | 3/1913 | Parsons | 2/139 X |
| 1,076,381 | 10/1913 | Lever | 2/141 R |
| 1,190,504 | 7/1916 | Bernstein | 2/127 |
| 1,635,120 | 7/1927 | Furman | 2/127 |
| 2,025,485 | 12/1935 | Tucker | 2/127 |
| 2,099,520 | 11/1937 | Hendrycy | 2/131 X |
| 2,120,147 | 6/1938 | Ide | 2/131 X |
| 2,151,652 | 3/1939 | Donner | 2/131 |
| 2,396,842 | 3/1946 | Franklin | 2/137 X |
| 3,393,406 | 7/1968 | Hollinger et al. | 2/129 |
| 3,430,264 | 3/1969 | Beukenkamp, Jr. | 2/141 |
| 3,860,967 | 1/1975 | Tedesco | 2/129 |

FOREIGN PATENT DOCUMENTS

| | | | |
|---|---|---|---|
| 301997 | 12/1928 | United Kingdom | 2/127 |

*Primary Examiner*—Werner H. Schroeder
*Assistant Examiner*—Jeanette E. Chapman
*Attorney, Agent, or Firm*—Walter F. Wessendorf, Jr.

[57] ABSTRACT

A shirt whose collar has an internal portion interfacing with an external turned-down collar portion. The internal interfacing portion and external turned-down portion are separated by a common elastic insert joined thereto and said elastic insert allows both the internal interfacing portion and external turned-down portion to correspondingly expand radially and comfortably to accommodate spatial necessity of a wearer occasioned when the wearer's neck swells or the wearer moves his neck.

4 Claims, 1 Drawing Sheet

EXPANDABLE SHIRT COLLAR

BACKGROUND OF THE INVENTION

1. Technical Field

This invention relates to a shirt collar whose internal interfacing portion and external turned-down collar portion have a common insert of suitable elastic material, thereby allowing the internal interfacing portion and external turned-down collar portion to radially expand to spatially accommodate neck swelling of the wearer and neck movement by the wearer to thereby provide the wearer with comfort and a comfortable fit vis-a-vis his neck.

2. Background

The problem in the art to which this invention apertains is the fact that a shirt collar becomes uncomfortable around a wearer's neck upon neck movement by the wearer and when the wearer's neck swells.

SUMMARY OF THE INVENTION

To contribute to the solution of and to correct this discussed problem of the prior art, the internal interfacing portion of the shirt collar and the external turned-down collar portion are provided with a common insert of elastic material which is radially expandable to accommodate spatial necessity occasioned by neck swelling by the wearer and neck movement by the wearer thereby providing the wearer with a comfortable collar fit around his neck and hence comfort.

BRIEF DESCRIPTION OF THE DRAWINGS

This object and other objects of the invention should be discerned and appreciated from the description of the preferred embodiment taken in conjunction with the drawing, wherein like reference numerals refer to similar parts throughout the drawing figures, in which.

DESCRIPTION OF THE PREFERRED EMBODIMENT

Figure 1:
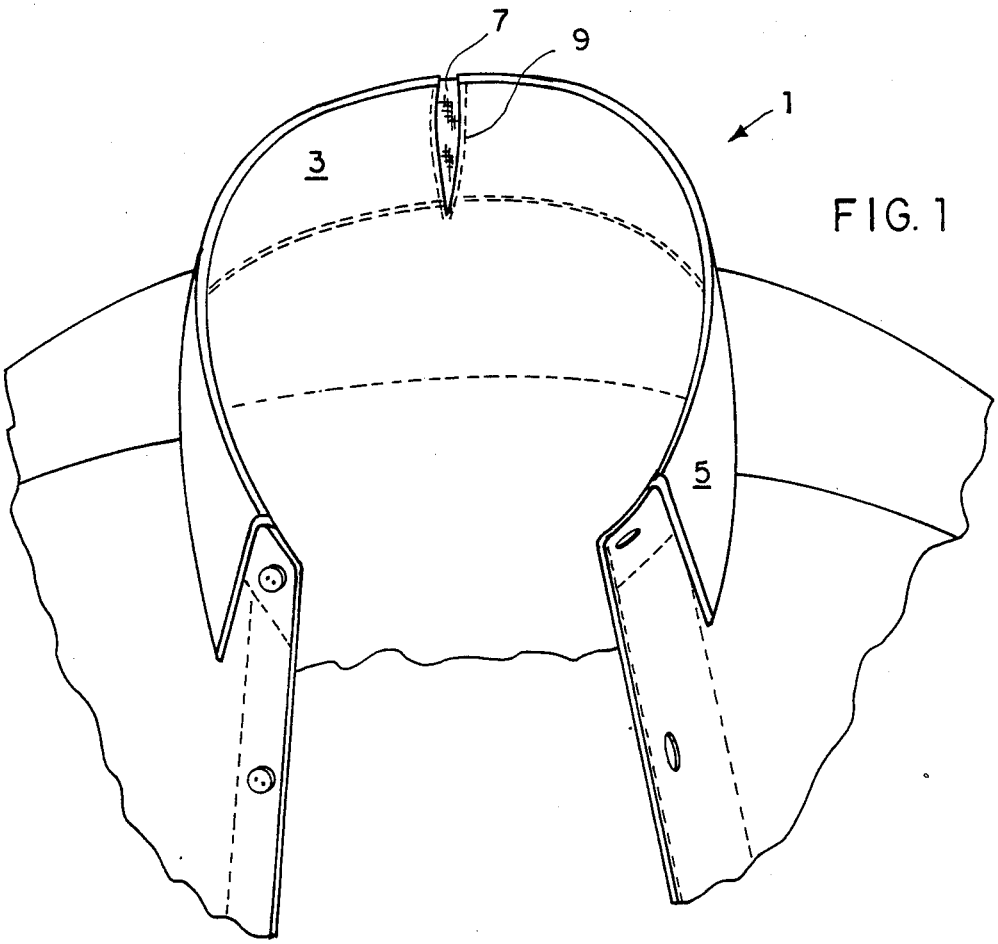
FIG. 1 is a front view of the invention.
Figure 2:
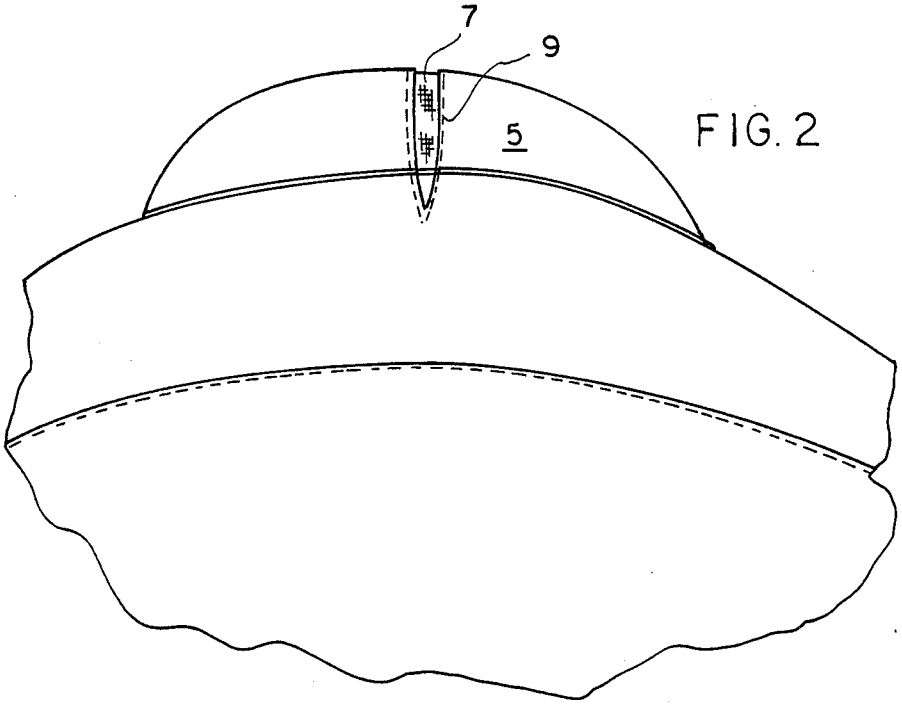
FIG. 2 is a rear view thereof.

In FIG. 1 of the drawings, reference numeral 1 generally refers to the invention, showing the shirt collar whose internal portion 3 interfaces with the collar's external turned-down portion 5. The lateral portions, as shown, of a common insert 7 of suitable elastic material are suitably joined, such as by stitching 9, to the laterally facing portions of a longitudinal separation, as shown, formed in the rear middle portion of the collar's internal interfacing portion 3 and external turned-down portion 5, and such longitudinal separation extends, as shown, from the collar's internal interfacing portion 3 to its external turned-down portion 5. Such elastic insert 7 allows both the collar's internal interfacing portion 3 and its external turned-down portion 5 to correspondingly expand radially and comfortably to accommodate spatial necessity occasioned when the shirt of the wearer is buttoned, and the wearer's neck swells or the wearer moves his neck. In accommodating such spatial necessity, such expansion is automatic.

I claim:

1. A shirt having an integral collar with an internal interfacing portion and an external turned-down portion, said internal interfacing portion and external turned-down portion being vertically split to form opposed end portions and define a longitudinal separation of uniform radial width over a given area, said longitudinal separation extending completely through said internal interfacing and external turned-down portions, said collar having a longitudinal elastic insert of uniform width over most of its area, said elastic insert being complemental with said longitudinal separation, said elastic insert having lateral portions joined with said opposed end portions of said longitudinal separation, said elastic insert allowing both said collar's internal interfacing and external turned-down portions to automatically, correspondingly and comfortably expand circumferentially around a wearer's neck to accommodate spatial necessity occasioned when the wearer's neck swells or the wearer moves his neck.

2. A shirt in accordance with claim 1, wherein said collar's internal interfacing portion and its external turned-down portion have a common rear middle portion forming said longitudinal separation.

3. A shirt in accordance with claim 1, wherein said collar has stitching joining said elastic insert's lateral portions to said opposed end portions of said collar's internal interfacing portion and its external turned-down portion.

4. A shirt in accordance with claim 2, wherein said collar has stitching joining said elastic insert's lateral portions to said opposed end portions of said collar's internal interfacing portion and its external turned-down portion.

* * * * *